US011222602B2

(12) United States Patent
Kim

(10) Patent No.: US 11,222,602 B2
(45) Date of Patent: Jan. 11, 2022

(54) DISPLAY DEVICE AND METHOD OF DRIVING THE DISPLAY DEVICE

(71) Applicant: Samsung Display Co., Ltd., Yongin-si (KR)

(72) Inventor: Won Tae Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/813,578

(22) Filed: Mar. 9, 2020

(65) Prior Publication Data

US 2020/0312253 A1 Oct. 1, 2020

(30) Foreign Application Priority Data

Mar. 27, 2019 (KR) ..... 10-2019-0035079

(51) Int. Cl.

| | |
|---|---|
| ***G09G 3/3291*** | (2016.01) |
| ***G09G 3/3266*** | (2016.01) |
| ***G09G 3/00*** | (2006.01) |
| ***G09G 3/20*** | (2006.01) |
| ***G09G 3/3208*** | (2016.01) |
| ***G09F 9/30*** | (2006.01) |

(52) U.S. Cl.

CPC ..... *G09G 3/3291* (2013.01); *G09G 3/3266* (2013.01); *G09G 2310/08* (2013.01); *G09G 2356/00* (2013.01); *G09G 2380/02* (2013.01)

(58) Field of Classification Search

USPC ..... 345/204

See application file for complete search history.

(56) References Cited

U.S. PATENT DOCUMENTS

| | | | | |
|---|---|---|---|---|
| 10,013,912 | B2 | 7/2018 | Kim et al. | |
| 10,777,115 | B2 * | 9/2020 | Lee | G09G 3/2007 |
| 2011/0032231 | A1 * | 2/2011 | Maruyama | G09G 3/2096 345/208 |
| 2013/0215041 | A1 * | 8/2013 | Kim | G06F 3/0346 345/173 |
| 2014/0002468 | A1 * | 1/2014 | Sung | G09G 5/14 345/536 |
| 2014/0009449 | A1 | 1/2014 | Jang | |

(Continued)

FOREIGN PATENT DOCUMENTS

| | | |
|---|---|---|
| KR | 10-20150109992 | 10/2015 |
| KR | 10-2016-0029222 | 3/2016 |

(Continued)

*Primary Examiner* — Chineyere D Wills-Burns

(74) *Attorney, Agent, or Firm* — H.C. Park & Associates, PLC

(57) ABSTRACT

A display device and a method of driving same in which the display device includes: a display panel including first and second display areas; a processor to generate first image data corresponding to the first and second display areas in a first mode, and generate second image data corresponding to the first display area in a second mode; and a display driver to control the display panel to display an image corresponding to the first image data in the first and second display areas according to a first frame period in the first mode, and to display an image corresponding to the second image data in the first display area according to a second frame period in the second mode. The second frame period is shorter than the first frame period.

20 Claims, 9 Drawing Sheets

(56) References Cited

U.S. PATENT DOCUMENTS

| | | | | |
|---|---|---|---|---|
| 2015/0243212 | A1* | 8/2015 | Lee | G09G 3/3216 345/212 |
| 2015/0253884 | A1 | 9/2015 | Hwang | |
| 2015/0255016 | A1 | 9/2015 | An et al. | |
| 2015/0316976 | A1* | 11/2015 | Toyotaka | G06F 1/1641 361/679.27 |
| 2016/0071457 | A1 | 3/2016 | Kim et al. | |
| 2016/0321974 | A1 | 11/2016 | Chun et al. | |
| 2017/0003714 | A1* | 1/2017 | Kwon | G06F 1/1615 |
| 2017/0110080 | A1* | 4/2017 | Moh | G09G 5/18 |
| 2017/0301280 | A1* | 10/2017 | Ka | G09G 3/3406 |
| 2018/0102096 | A1* | 4/2018 | Lee | G09G 3/3266 |
| 2018/0197480 | A1* | 7/2018 | Choi | H04N 13/344 |
| 2018/0322831 | A1* | 11/2018 | Kim | G09G 3/3266 |
| 2018/0342192 | A1* | 11/2018 | Lee | G06F 1/1652 |
| 2020/0193900 | A1* | 6/2020 | Chen | G09G 3/20 |
| 2020/0302843 | A1 | 9/2020 | Chun et al. | |
| 2020/0326752 | A1* | 10/2020 | Jung | G06F 1/1652 |

FOREIGN PATENT DOCUMENTS

| | | |
|---|---|---|
| KR | 10-2016-0130027 | 11/2016 |
| KR | 10-2018-0039797 | 4/2018 |

* cited by examiner

DISPLAY DEVICE AND METHOD OF DRIVING THE DISPLAY DEVICE

CROSS REFERENCE TO RELATED APPLICATION

This application claims priority from and the benefit of Korean Patent Application No. 10-2019-0035079, filed on Mar. 27, 2019, which is hereby incorporated by reference for all purposes as if fully set forth herein.

BACKGROUND

Field

Exemplary implementations of the invention relate generally to display devices and, more specially, to flexible display panel and a method of driving the flexible display device to improve the image output rate in a partial display mode.

DISCUSSION OF THE BACKGROUND

Recently, a display device capable of deforming at least one area of a display panel, such as a foldable display device or a rollable display device, has been developed. Accordingly, demand for display devices to provide various functions and efficient operation depending on the configuration or use of the display also has been increased.

The above information disclosed in this Background section is only for understanding of the background of the inventive concepts, and, therefore, it may contain information that does not constitute prior art.

SUMMARY

Applicant discovered that in foldable or rollable display devices that provide not only an entire display mode to display an active image by using all of the display area but also a partial display mode to display an active image by using only a portion of the display area, delay or image quality can be compromised depending upon the display mode selected.

Display devices constructed according to the principles and exemplary implementations of the invention and methods of driving the display devices according to the principles of the invention are capable of being selectively driven in an entire display mode or a partial display mode depending on a use environment or state thereof, so that the convenience of use can be improved.

Further, display devices constructed according to the principles and exemplary implementations of the invention and methods of driving the display devices according to the principles of the invention are capable of improving an image output rate while the display device is being driven in the partial display mode, so that an image that requires a high frame rate, such as a game or sport, can be efficiently displayed in the partial display mode.

Additional features of the inventive concepts will be set forth in the description which follows, and in part will be apparent from the description, or may be learned by practice of the inventive concepts.

According to an aspect of the invention, a display device includes: a display panel including first and second display areas; a processor to generate first image data corresponding to the first and second display areas in a first mode, and generate second image data corresponding to the first display area in a second mode; and a display driver to control the display panel to display an image corresponding to the first image data in the first and second display areas according to a first frame period in the first mode, and to display an image corresponding to the second image data in the first display area according to a second frame period in the second mode, the second frame period being shorter than the first frame period.

The first image data may include image data corresponding to pixels constituting the first and second display areas, and the second image data may include image data corresponding to pixels constituting the first display area. The first image data may be generated according to the first frame period, and the second image data may be generated according to the second frame period.

The display driver may include: a timing controller to generate a data control signal and a scan control signal in response to a control signal of the processor; a data driver to output a first or second data signal corresponding to the first or second image data in response to the data control signal; and a scan driver to output a scan signal in response to the scan control signal.

The timing controller may be operable to output the scan control signal according to the first frame period in the first mode, and output the scan control signal in the second frame period in the second mode.

The data driver may be operable to output the first data signal according to the first frame period in the first mode, and output the second data signal in the second frame period in the second mode.

The display driver may further include: a first emission driver to supply a first emission signal to the first display area in response to a first emission control signal from the timing controller; and a second emission driver to supply a second emission signal to the second display area in response to a second emission control signal from the timing controller.

The timing controller may not output the second emission control signal in the second mode.

The display device may further include a sensor to output a sensing signal by sensing a change in state of the display panel.

The processor may operate in the first or second mode, corresponding to the sensing signal.

The change in state may include deformation of the display panel.

The display panel may be driven in the second mode when the display panel is outwardly folded with respect to a predetermined folding axis.

The first display area may be an area exposed in a first direction by the outwardly folding of the display panel, and the second display area may be an area exposed in a second direction opposite to the first direction by the outwardly folding of the display panel.

According to another aspect of the invention, a method of driving a display device includes the steps of: selecting one of first and second driving modes; when the first driving mode is selected, displaying a first image corresponding to first image data in first and second display areas according to a first frame period; and when the second driving mode is selected, displaying a second image corresponding to second image data in the first display area according to a second frame period, wherein the second period is shorter than the first frame period.

The step of displaying of the first image may include: generating a scan control signal and a data control signal according to the first frame period; and outputting a scan signal in response to the scan control signal, and outputting a first data signal corresponding to the first image data in response to the data control signal.

The step of displaying of the second image may include: generating a scan control signal and a data control signal according to the second frame period; and outputting a scan signal in response to the scan control signal, and outputting a second data signal corresponding to the second image data in response to the data control signal.

The step of displaying of the first image may further include the step of: generating first and second emission control signals; and supplying first and second emission signals to the first and second display areas in response to the first and second emission control signals.

The step of displaying of the second image may further include the step of: generating a first emission control signal; and supplying a first emission signal to the first display area in response to the first emission control signal.

The step of selecting of the one of the first and second driving modes may include: sensing a change in state of the display panel; and selecting the first driving mode or the second driving mode, based on the sensing result.

The step of selecting of the first driving mode or the second driving mode may include selecting the second driving mode, when the display panel is outwardly folded with respect to a predetermined folding axis.

The first display area may be an area exposed in a first direction by the outwardly folding of the display panel, and the second display area may be an area exposed in a second direction opposite to the first direction by the outwardly folding of the display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
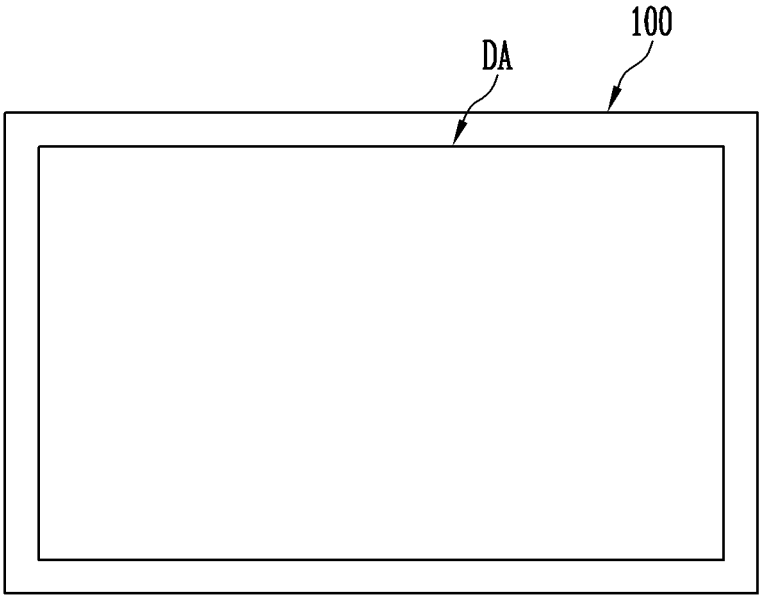
FIG. 1 is a schematic plan view of an exemplary embodiment of a display panel constructed according to the principles of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2:
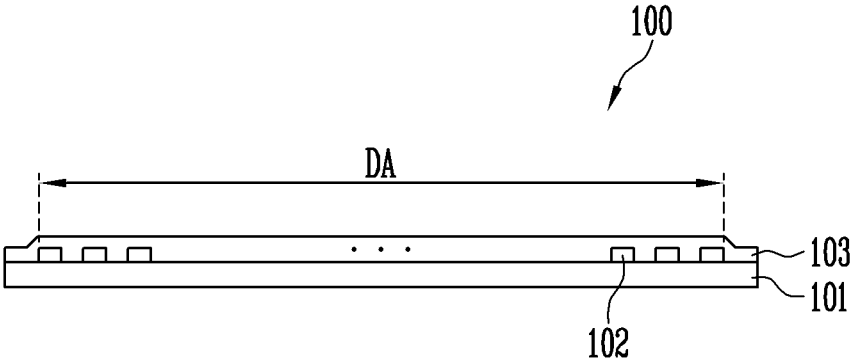
FIG. 2 is a schematic cross-sectional view of the display panel of FIG. 1.
Figure 3:
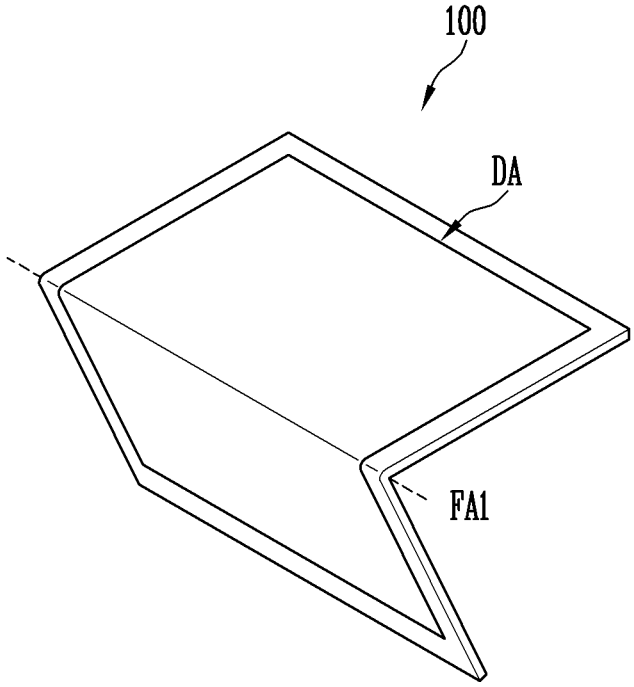
FIGS. 3 and 4 are perspective views of the display panel of FIG. 1 in folded states.
Figure 4:
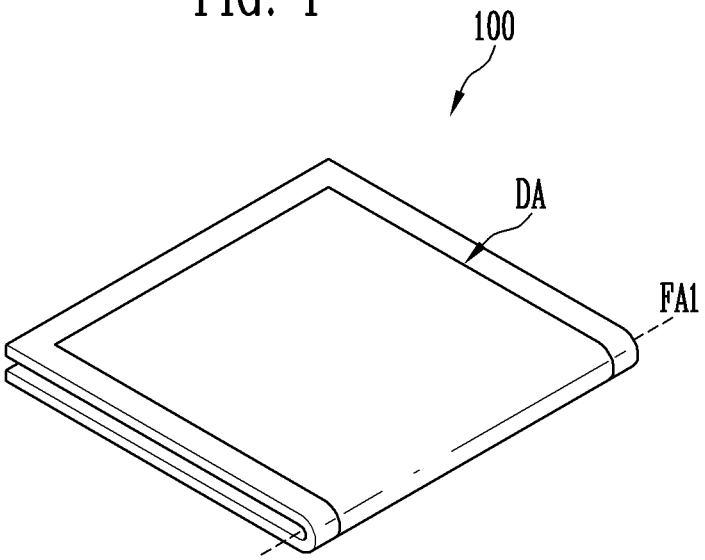

FIG. 1 is a schematic plan view of an exemplary embodiment of a display panel constructed according to the principles of the invention. FIG. 2 is a schematic cross-sectional view of the display panel of FIG. 1. FIGS. 3 and 4 are perspective views of the display panel of FIG. 1 in folded states.

First, referring to FIGS. 1 and 2, the display panel 100 may include a display area DA. The display area DA supplies a data signal corresponding to image data, and displays an image corresponding to the data signal. In exemplary embodiments, the display panel 100 may be a flexible display panel. In an example, at least one area of the display panel 100 may be flexibly implemented to be bendable, foldable, and/or rollable.

In exemplary embodiments, the display panel 100 may be a flexible organic light emitting display panel that includes a flexible substrate 101, a plurality of pixels 102 provided on the flexible substrate 101, and a flexible thin film encapsulation layer 103 encapsulating the pixels 102. However, in the illustrated exemplary embodiment, the kind and/or shape of the display panel 100 is not particularly limited.

In exemplary embodiments, the substrate 101 may be implemented with a thin film made of a flexible material, or the like. In an exemplary embodiment, the substrate 101 may include at least one of polyethersulfone (PES), polyacrylate (PA), polyetherimide (PEI), polyethylene naphthalate (PEN), polyethylene terephthalate (PET), polyphenylene sulfide (PPS), polyarylate (PAR), polyimide (PI), polycarbonate (PC), triacetate cellulose (TAC), and cellulose acetate propionate (CAP). However, the material constituting the substrate 101 is not limited thereto, and the substrate 101 may be configured using a material that satisfies flexibility having a predetermined range, in addition to the above-described material.

In exemplary embodiments, the thin film encapsulation layer 103 may be an encapsulation layer having a multi-layered structure including at least one organic layer and at least one inorganic layer. For example, the thin film encapsulation layer 103 may include first and second inorganic layers overlapping with each other and at least one organic layer interposed between the first and second inorganic layers. Meanwhile, in an exemplary embodiment, the thin film encapsulation layer 103 may be an encapsulation layer having a single-layered structure complexly including organic and inorganic materials.

Next, referring to FIGS. 3 and 4, the display panel 100 may be an outwardly foldable display panel in which the display area DA can be folded toward the outside with respect to a first folding axis FA1. Alternatively, the display panel 100 may be a display panel implemented such that both inward and outward folding of the display panel 100 are possible.

In exemplary embodiments, the display panel 100 may display a active image in the entire display area DA in a state in which the display panel 100 is not deformed, e.g., a state in which the display panel 100 is unfolded and substantially flat. Also, the display panel 100 may display a active image in only a partial area in the display area DA, e.g., a partial area exposed to a user in a state in which the display panel 100 is deformed, e.g., a state in which the display panel 100 is bent and/or folded as shown in FIG. 4. Therefore, the display panel 100 may display a black image or display no image in another area, e.g., a partial area that is not exposed to the user.

In other words, the display panel 100 may display a active image in the entire display area DA in a state in which the display panel 100 is not deformed, and reduce and display a active image to be displayed in the entire display area DA in a partial area exposed to the user in a state in which the display panel 100 is deformed.

Figure 5:
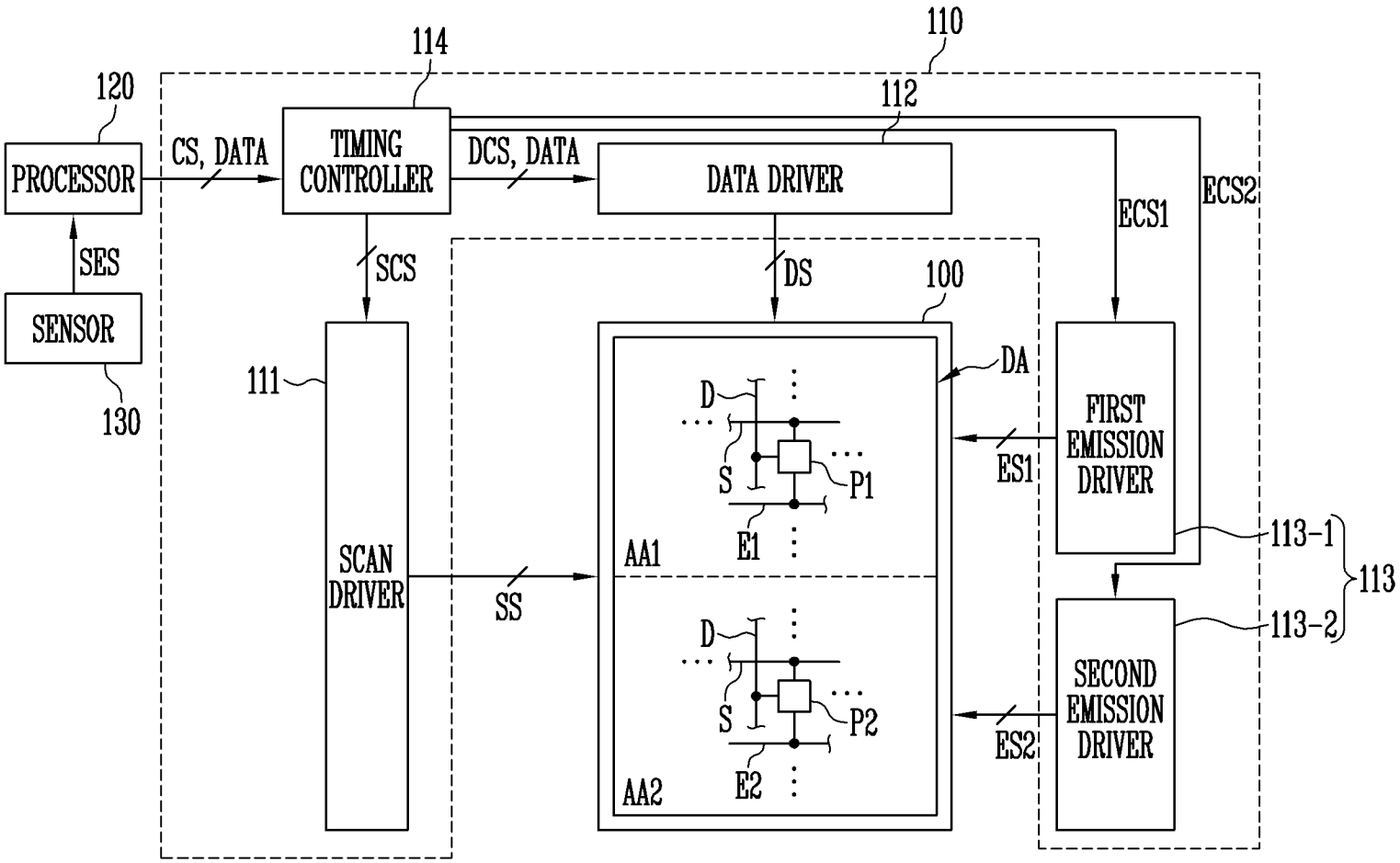
FIG. 5 is a block diagram of an exemplary embodiment of a display device constructed according to the principles of the invention

FIG. 5 is a block diagram of an exemplary embodiment of a display device constructed according to the principles of the invention.

Referring to FIG. 5, the display device in accordance with the exemplary embodiment may include a display panel 100, a display driver 110, a processor 120, and a sensor 130.

The display panel 100 may be the display panel described with reference to FIGS. 1 and 4. The display panel 100 may be bendable, foldable, and/or rollable. For example, the display panel 100 may be a foldable display panel that can be folded with respect to a predetermined folding axis.

The display device having the display panel 100 may display an active image in different areas (e.g., areas having different sizes, different positions, and/or different ranges) in the entire display area DA depending on the use environment, condition, and/or state. For example, the mode of the display device may be switched to a partial display mode such that the display device is driven in the partial display mode in a state in which the display device is outwardly folded, and the display device may display a predetermined valid image by using only a partial area exposed to a user in the entire display area DA during a period in which the partial display mode is executed. Therefore, the valid image displayed in only the partial area exposed to the user in the entire display area DA may be an image having a reduced size with respect to a valid image displayed in the entire display area DA.

In exemplary embodiments, the display area DA may have an elongated shape in the vertical direction as shown in FIG. 5, but the exemplary embodiments are not limited thereto. That is, the shape or disposition direction of the display area DA is not particularly limited. Also, the display area DA may have an elongated shape in the horizontal direction or vertical direction according to the use direction of the display device, and an image displayed in the display area DA may be rotated according to the use direction. For example, in exemplary embodiments, the display area DA may be disposed in a landscape form or be disposed in a portrait form.

In exemplary embodiments, the display area DA may be divided into a plurality of sub-areas. For example, the display area DA may include a first display area AA1 and a second display area AA2. In the exemplary embodiments, the number of sub-areas (e.g., the first and second display areas AA1 and AA2) constituting the display area DA is not particularly limited.

The first display area AA1 and the second display area AA2 may be adjacent to each other. For example, the first display area AA1 and the second display area AA2 may be vertically adjacent to each other as shown in FIG. 5. In exemplary embodiments, the first display area AA1 and the second display area AA2 may be directly adjacent to each other, but the exemplary embodiments are not limited thereto.

In exemplary embodiments, at least one type of lines selected from the can lines S, data lines D, and emission control lines E1 and E2, which are disposed in the first display area AA1 and the second display area AA2, may be continuously disposed without interruption at a boundary between the first display area AA1 and the second display area AA2. For example, in the exemplary embodiment shown in FIG. 5, each data line D may be continuously disposed between first display area AA1 and the second display area AA2. However, the exemplary embodiments are not limited thereto. For example, in another exemplary embodiment, at least one type of the lines or at least some of the lines may be discontinuously disposed between the first display area AA1 and the second display area AA2.

The first display area AA1 and the second display area AA2 may include a plurality of first pixels P1 and a plurality of second pixels P2, respectively. In the exemplary embodiment shown in FIG. 5, the first display area AA1 may include a plurality of first pixels P1 coupled to scan lines S, data lines D, and first emission control lines E1. In addition, the second display area AA2 may include a plurality of second pixels P2 coupled to scan lines S, data lines D, and second emission control lines E2.

Each of the first pixels P1 and the second pixels P2 may be selected when a scan signal SS having a gate-on voltage is supplied from a corresponding scan line S, to be supplied with a data signal DS from a corresponding data line D, and emit light with a luminance corresponding to the data signal DS when an emission signal ES having a gate-on voltage is supplied from a corresponding emission control line E1 or E2. In exemplary embodiments, the first pixels P1 and the second pixels P2 are supplied with a data signal DS of a corresponding frame for every frame period, and emit light with a luminance corresponding to the data signal DS. Accordingly, a predetermined image corresponding to the data signal DS is displayed in the display area DA.

The display driver 110 includes a scan driver 111, a data driver 112, an emission driver 113, and a timing controller 114.

The scan driver 111 is supplied with a scan control signal SCS from the timing controller 114, and generates a scan signal SS in response to the scan control signal SCS. In exemplary embodiments, the scan control signal SCS may include a gate start pulse and at least one gate shift clock. The scan driver 111 may sequentially generate scan signals SS by sequentially shifting the gate start pulse, using the gate shift clock, and supply the scan signals SS to the scan lines S.

The data driver 112 is supplied with a data control signal DCS and image data DATA from the timing controller 114. In exemplary embodiments, the data control signal DCS may include a source start pulse, a source shift clock, and a source output enable signal. The data driver 112 generates a data signal DS corresponding to the image data by using the data control signal DCS, and supplies the data signal to the data lines D. For example, the data driver 112 may supply, to the data lines D, a data signal DS corresponding to a horizontal pixel column corresponding to each of a plurality of horizontal periods constituting each frame period.

In exemplary embodiments, a partial area, e.g., the second display area AA2 in the entire display area DA may be set as an inactive display area depending on the use environment or state of the display device (e.g., whether the display panel 100 is deformed and/or a degree of the deformation). For example, the second display area AA2 may be set as the inactive display area when the second display area AA2 is not exposed to a user due to folding of the display panel 100 as shown in FIG. 4.

When the second display area AA2 is set as the inactive display area, the data driver 112 may not supply a data signal DS corresponding to the pixels disposed in the second display area AA2. Any second emission signal ES2 is not supplied to the second pixels P2 disposed in the second display area AA2, so that the second display area AA2 is controlled so as to not to emit light.

When a data signal DS for the second display area AA2 is not supplied to the pixels disposed in the second display area AA2 since the second display area AA2 is set as the inactive display area, the active image for the entire display area DA may be reduced to the active image for the first display area AA1 to be entirely displayed in the first display area AA1. The reduced valid image may be configured by extracting images for odd-numbered pixel rows of the entire display area DA (i.e., odd-numbered pixel rows of the first display area AA1 and odd-numbered pixel rows of the second display area AA2). Alternatively, the reduced active image may be configured by extracting images for even-numbered pixel rows of the entire display area DA (i.e., even-numbered pixel rows of the first display area AA1 and even-numbered pixel rows of the second display area AA2). Thus, the reduced active image may be generated using data corresponding to half of the entire display area AA. However, the exemplary embodiments are not limited thereto, and a active image may be reduced in various manners.

When the size of an area in which a active image is displayed is reduced while a supply rate of the data signal DS is being equally maintained, the display rate of the active image may be increased. Accordingly, in the illustrated exemplary embodiment, when an active image is displayed in the first display area AA1, the active image can be displayed at a frame rate higher than that when a active image is displayed in the entire display area DA.

Specifically, when a data signal DS for the second display area AA2 is not supplied to the pixels disposed in the second display area AA2 since the second display area AA2 is set as the inactive display area, data signals DS for a plurality of active images (e.g., first active image and second active image) may be supplied to the first display area AA1 during a frame period (e.g., first frame period). For example, the first frame period is a frame period that corresponds to the entire display area DA. That is, during one half of the first frame period, a data signal for a first active image may be supplied to the first display area AA1, and during the other half of the first frame period, a data signal for a second active image may be supplied to the first display area AA1. The second active image may be a copy of the first active image or be the next scene of the first active image.

Therefore, the one frame period that corresponds to the entire display area DA, i.e., the first frame period, may result in that the one frame period is substantially divided into two frame periods (e.g. two second frame periods). For example, the second frame period may be a frame period that corresponds to the first display area AA. Accordingly, dividing the first frame period to the two second frame period may have the effect of is increasing the driving frequency of the display panel 100. For example, when the driving frequency of the display panel 100 corresponding to the first frame period is 60 Hz before the second display area AA2 is set as the inactive display area, the driving frequency of the display panel 100 corresponding to the second frame period may be substantially 120 Hz after the second display area AA2 is set as the inactive display area.

The emission driver 113 may include a first emission driver 113-1 coupled to the first emission control lines E1 and a second emission driver 113-2 coupled to the second emission control lines E2. In exemplary embodiments, when n (n is a natural number of 2 or more) horizontal pixel rows are disposed in the display panel 100, the first emission control lines E1 may include n/2 emission control lines respectively coupled to first to n/2th horizontal pixel rows, and the second emission control lines E2 may include n/2 emission control lines respectively coupled to (n/2+1)th to nth horizontal pixel rows.

The emission driver 113 is supplied with emission control signals ECS1 and ECS2 from the timing controller 114, and generates an emission signal ES, corresponding to the emission control signals ECS1 and ECS2. In exemplary embodiments, the emission control signals ECS1 and ECS2 may include first and second emission start pulses and at least one emission shift clock. The first emission start pulse may be supplied to the first emission driver 113-1, and the second emission start pulse may be supplied to the second emission driver 113-2. In exemplary embodiments, the supply time of the first emission start pulse and a supply time of the second emission start pulse may be different from each other. For example, the first emission start pulse and the second emission start pulse may be alternately supplied at an interval of a half frame.

The first and second emission drivers 113-1 and 113-2 may sequentially generate first and second emission signals ES1 and ES2 by sequentially shifting the first and second emission start pulses, using the emission shift clock, and respectively supply the first and second emission signals ES1 and ES2 to the first emission control lines E1 and the second emission lines E2.

In an exemplary embodiment in which the first emission start pulse and the second emission start pulse are supplied at an interval of a half frame, the interval between a last first emission signal ES1 generated and supplied by shifting the first emission start pulse and a first second emission signal ES2 generated and supplied in response to the second emission start pulse may be one horizontal period 1H. In other words, when the first emission signal ES1 is supplied to the last first emission control line (e.g., an n/2th first emission control line) from the first emission driver 113-1, the second emission start pulse may be supplied to the second emission driver 113-2. Then, the first emission signal ES1 may be supplied to the last first emission control line from the first emission driver 113-1, and the second emission driver 113-2 may output the first second emission signal in response to the second emission start pulse, when one horizontal period elapses.

In exemplary embodiments, the timing controller 114 may sequentially generate the first emission start pulse and the second emission start pulses to the first emission driver 113-1 and the second emission driver 113-2, while the display device is operating in the entire display mode. Also, the timing controller 114 may not supply the second emission start pulse, while the display device is operating in the partial display mode. For example, the timing controller 114 may supply only the first emission start pulse to the first emission driver 113-1, while the display device is operating in the partial display mode. Therefore, the first emission start pulse may be supplied plural times during one frame period, while the display device is operating in the partial display mode. For example, the first emission start pulse may be supplied at an interval of a half frame, while the display device is operating in the partial display mode.

Although an exemplary embodiment in which the display device includes two emission drivers 113-1 and 113-2 is illustrated in FIG. 5, the exemplary embodiments are not limited thereto. For example, in exemplary embodiments, when a plurality of active display areas and a plurality of inactive display areas are mounted on the display panel 100, corresponding to states in which the display panel 100 is deformable, the emission driver 113 may be provided in three or more units, corresponding to the display areas. Therefore, emission start pulses for the emission drivers may be respectively supplied to the emission drivers at an interval shorter than that of a half frame. For example, in an exemplary embodiment in which three emission drivers are provided, emission start pulses for the emission drivers may be sequentially supplied to the emission drivers at an interval of 1/3 frame.

The timing controller 114 is supplied with a control signal CS and image data DATA from the processor 120. In exemplary embodiments, the control signal CS may include a horizontal synchronization signal and a vertical synchronization signal. Also, the control signal CS may further include a selection signal for selecting a display mode. The display mode may include, for example, an entire display mode (first mode) and a partial display mode (second mode).

The timing controller 114 may drive the scan driver 111, the data driver 112, and the emission driver 113, corresponding to the control signal CS and the image data DATA. For example, the timing controller 114 may generate a scan control signal SCS, a data control signal DCS, and an emission control signals ECS1 and ECS2, corresponding to the control signal CS. The timing controller 114 may supply the scan control signal SCS to the scan driver 111, supply the data control signal DCS to the data driver 112, and supply the emission control signals ECS1 and ECS2 to the emission driver 113. Also, the timing controller 114 may realign the image data DATA and supply the realigned image data DATA to the data driver 112.

Meanwhile, in exemplary embodiments, when the display device is driven in the partial display mode in which a reduced active image is displayed in a partial area of the display area DA, e.g., the first display area AA1, the image data DATA that the timing controller 114 receives from the processor 120 may be related to an image to be displayed in the first display area AA1. Therefore, the size and display rate of the image data DATA in one frame may be decreased as compared with those when the display device is driven in the entire display mode. As a result, one frame period, e.g., the second frame period in the partial display mode may be shorter than the first frame period in the entire display mode.

The processor 120 generates a control signal for driving the display driver 110 and/or the display panel 100 and image data DATA. In exemplary embodiments, the processor 120 may be an application processor of a mobile device. However, the type of the processor 120 is not limited thereto, and the processor 120 may be implemented as various types of processors corresponding to a corresponding display device.

In exemplary embodiments, the processor 120 may select the entire display mode or the partial display mode, and control the display driver 110 and/or the display panel 100 according to the selected mode.

For example, the processor 120 may receive a sensing signal SES from the sensor 130, and select any one of the entire display mode and the partial display mode, corresponding to the sensing signal SES. For convenience, in the exemplary embodiments, the display mode is divided into two modes, but the exemplary embodiments are not limited thereto. For example, the partial display mode may be segmented into a plurality of sub-partial display modes for partially displaying active images in areas having different positions and/or areas having different ranges.

In exemplary embodiments, the sensing signal SES may include information on deformation of the display panel 100, deformation degree and/or a deformation area. The processor 120 may select any one mode and/or any one active display area, corresponding to the sensing signal SES, and perform an operation corresponding to the selected mode. For example, the processor 120 may generate a selection signal corresponding to the selected mode, and generate image data DATA by matching an image to be displayed to the selected active display area.

In exemplary embodiments, the selection signal may be included in the control signal CS to be supplied to the display driver 110. Then, the display driver 110 may operate in the entire display mode or the partial display mode, corresponding to the selection signal. For example, the selection signal may be supplied to the timing controller 114 to control the supply of the first emission start pulse and the second emission start pulse. In addition, image data DATA corresponding to the active display area may be supplied to the timing controller 114.

The sensor 130 may include a sensing element for sensing a use environment and/or a state of the display device. For example, the sensor 130 may include a sensing element provided at the inside or periphery of the display panel 100 to sense a deformation, i.e., folding, bending, rolling, etc. of the display panel 100 to output a sensing signal SES corresponding to the sensed deformation. In the exemplary embodiments, the type of sensor 130 is not particularly limited. That is, the sensor 130 may be implemented as various types of sensing elements currently known in the art.

Although a case is illustrated in FIG. 5 where the scan driver 111, the data driver 112, the emission driver 113, and the timing controller 114 are separate components, the exemplary embodiments are not limited thereto. For example, in exemplary embodiments, the display driver 110 may be implemented with a TCON embedded driver IC (TED D-IC) having the timing controller 114 embedded therein. Therefore, at least one of the scan driver 111, the data driver 112, and the emission driver 113 may be integrated together with the timing controller 114 in the TED D-IC.

In addition, although a case is illustrated in FIG. 5 where the display driver 110 and the display panel 100 are separate components, the exemplary embodiments are not limited thereto. For example, in exemplary embodiments, at least one of the scan driver 111, the data driver 112, the emission driver 113, and the timing controller 114 may be integrated together with the first pixels P1 and the second pixels P2 in the display panel 100, or be mounted on one area of the display panel 100.

As described above, the display device may display an active image at an interval of a half frame (or an interval shorter than that of the half frame) during a period in which the display device is driven in the partial display mode. In other words, the display device can increase a frame rate by at least two times during the period in which the display device is driven in the partial display mode. Thus, an image that requires a high frame rate, such as a game or sport, can be efficiently displayed in the partial display mode.

Figure 6:
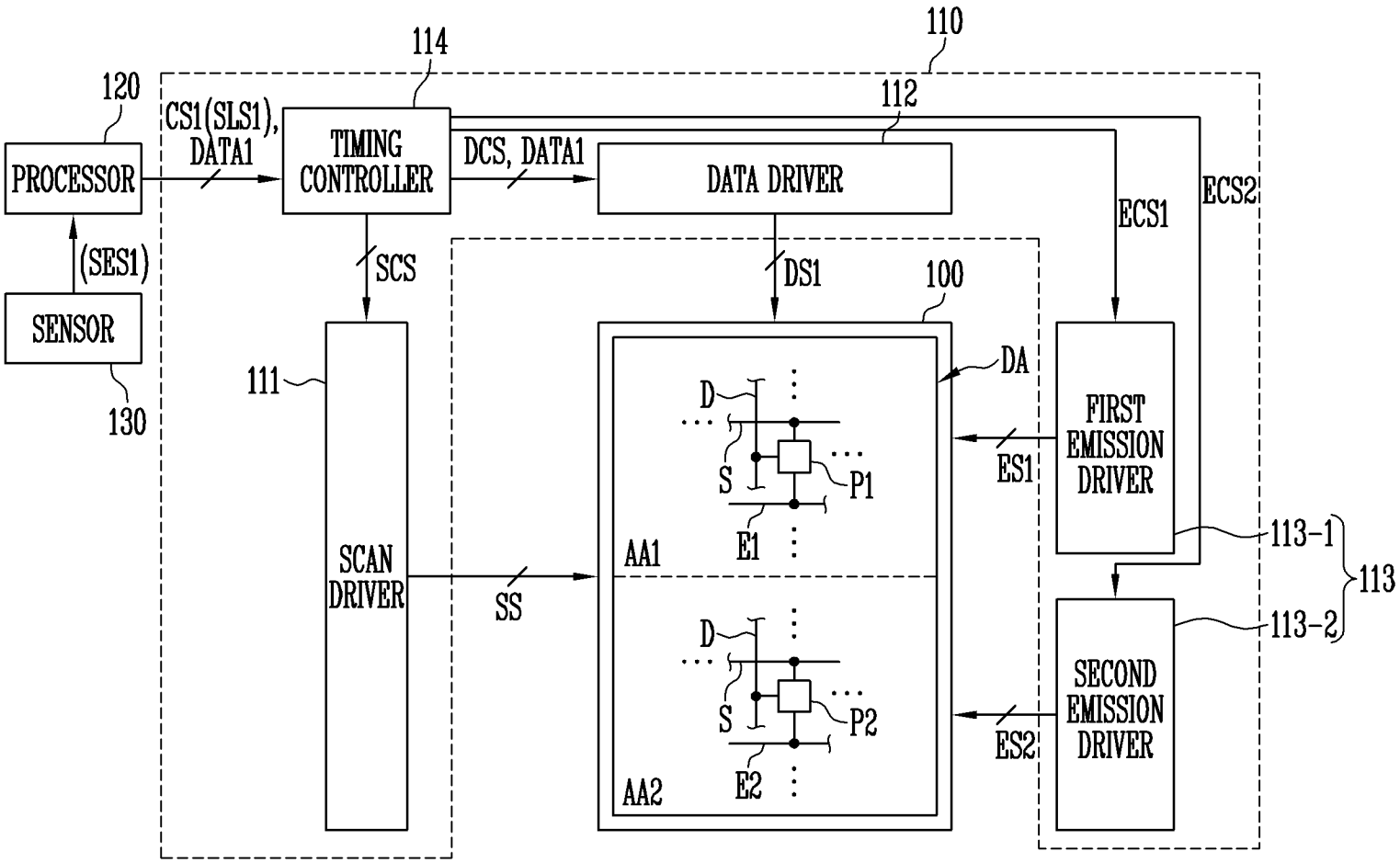
FIG. 6 is a block diagram illustrating an exemplary embodiment of the display device of FIG. 5 when the display device operates in a first mode.
Figure 7:
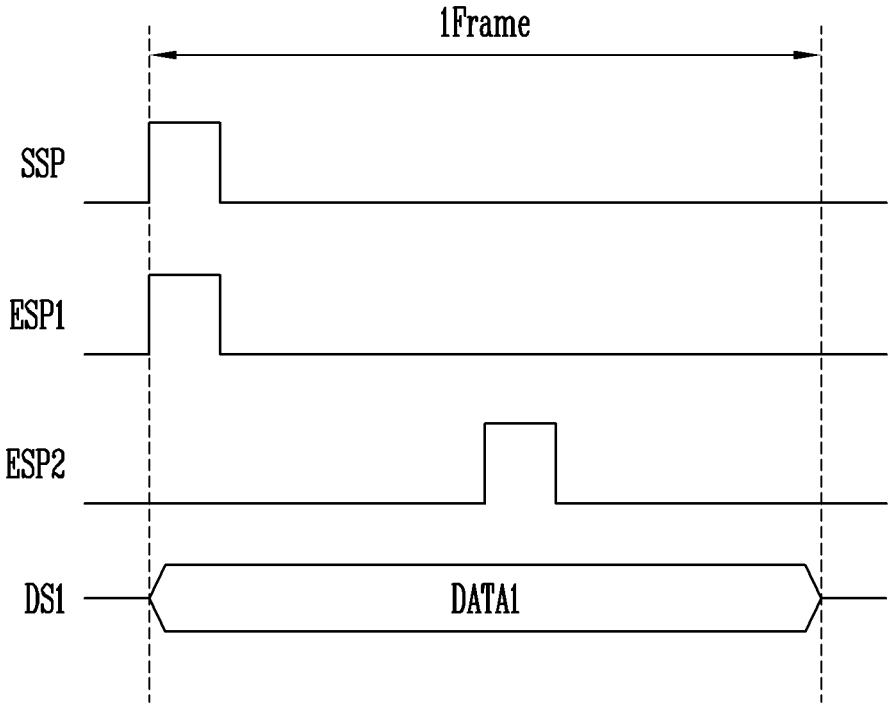
FIG. 7 is a timing diagram of signals applied to the display device of FIG. 5 when the display device operates in the first mode.
Figure 8:
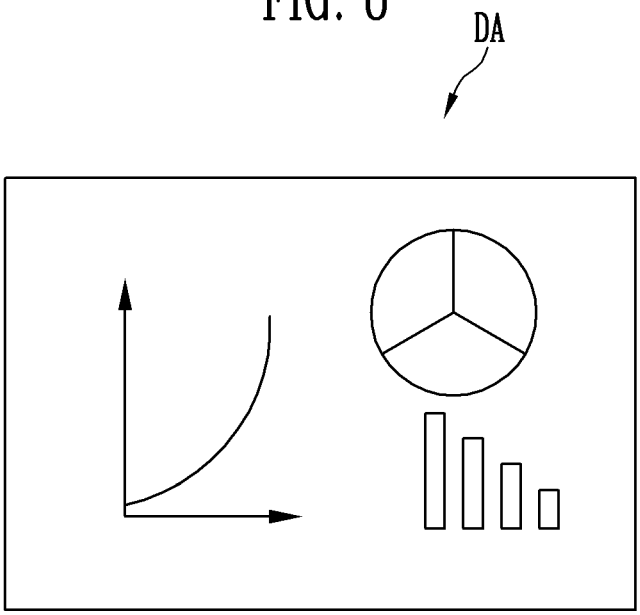
FIG. 8 is a diagram illustrating an example of an image displayed in a display area of the display device of FIG. 5 when the display device is driven in the first mode.

FIG. 6 is a block diagram illustrating an exemplary embodiment of the display device of FIG. 5 when the display device operates in the first mode. FIG. 7 is a timing diagram of signals applied to the display device of FIG. 5 when the display device operates in the first mode. FIG. 8 is a block diagram illustrating an example of an image displayed in the display area when the display device is driven in the first mode.

First, referring to FIGS. 6 and 7, the display device may be driven in the first mode depending on a predetermined use environment, a predetermined state, and/or a predetermined condition. In an exemplary embodiment, the first mode may be the entire display mode.

For example, the display device may be driven in the first mode when a first sensing signal SES1 is supplied from the sensor 130. In an exemplary embodiment, the first sensing signal SES1 may be a sensing signal corresponding to a state in which the display panel 100 is unfolded. Meanwhile, in another exemplary embodiment, the sensor 130 outputs a sensing signal only when the display panel 100 is deformed, and may not output the sensing signal in other cases. Therefore, the first sensing signal SES1 may be omitted, and the display device may be driven in the first mode while the sensing signal is not being received.

When the first sensing signal SES1 is received from the sensor 130 or when a predetermined sensing signal is not received, the processor 120 sets the entire display area DA including the first and second display areas AA1 and AA2 as an active display area, corresponding to the first mode, and generates first image data DATA1 for the entire display area DA. For example, the processor 120 may generate first image data DATA1 corresponding to the first and second display areas AA1 and AA2, corresponding to the first mode.

Also, the processor 120 may generate a first control signal CS1 corresponding to the first mode, and output the first control signal CS1 to the display driver 110. In some exemplary embodiments, the first control signal CS1 may include a first selection signal SLS1 including information on a selected display mode, i.e., the first mode. In another exemplary embodiment, when the display device is driven in the first mode, the generation of the first selection signal SLS1 may be omitted. Therefore, when a predetermined selection signal is not supplied from the processor 120, the display driver 110 may be set to operate in the first mode.

When the first selection signal SLS1 is supplied from the processor 120 or when a predetermined selection signal is not input, the display driver 110 may operate in the first mode. Specifically, the display driver 110 may generate a first data signal DS1 corresponding to the first image DATA1, corresponding to the first mode, and supply the first data signal DS1 to the first and second pixels P1 and P2 through the data lines D.

For example, the timing controller 114 may generate a scan control signal SCS and a data control signal DCS in response to the first control signal CS1, and supply the scan control signal SCS and the data control signal DCS respectively to the scan driver 111 and the data driver 112. The scan control signal SCS supplied to the scan driver 111 may include a gate start pulse SSP. Also, the timing controller 114 may supply the first image data DATA1 to the data driver 112.

In exemplary embodiments, the timing controller 114 may generate a first emission control signal ECS1 and a second emission control signal ECS2, using the first control signal CS1, and supply the first emission control signal ECS1 and the second emission control signal ECS2 respectively to the first and second emission drivers 113-1 and 113-2. The first emission control signal ECS1 may include a first emission start pulse ESP1, and the second emission control signal ECS2 may include a second emission start pulse ESP2. Therefore, the timing controller 114 may supply the first emission control signal ECS1 and the second emission control signal ECS2 respectively to the first emission driver 113-1 and the second emission driver 113-2 at an interval of a half frame.

In the exemplary embodiment described above, the scan driver 111 may generate a scan signal SS, corresponding to the gate start pulse SSP included in the scan control signal SCS, and sequentially supply the scan signal SS to the scan lines of the horizontal pixel columns disposed in the display panel 100. In addition, the data driver 112 may generate a first data signal DS1, corresponding to the data control signal DCS and the first image data DATA1, and supply the first data signal DS1 to the data lines D. In addition, the first and second emission drivers 113-1 and 113-2 may generate emission signals ES1 and ES2 at different times, based on the first emission start pulse ESP1 and the second emission start pulse ESP2, which are supplied at different times as described above, and respectively supply the emission signals ES1 and ES2 to the first emission control lines E1 and the second emission control lines E2.

The first data signals DS1 from the data driver 112 may be input to horizontal pixel columns supplied with the scan signal SS during a corresponding horizontal period. The first data signal DS1 may include data signals for a plurality of horizontal lines corresponding to the number of horizontal pixel columns disposed in the display panel 100, and the data signal for each horizontal line may be supplied to first pixels P1 or second pixels P2 of a corresponding horizontal pixel column during the corresponding horizontal period.

In accordance with the exemplary embodiment described above, a active image corresponding to the first image data DATA1 can be displayed in the entire display area DA as shown in FIG. 8.

Figure 9:
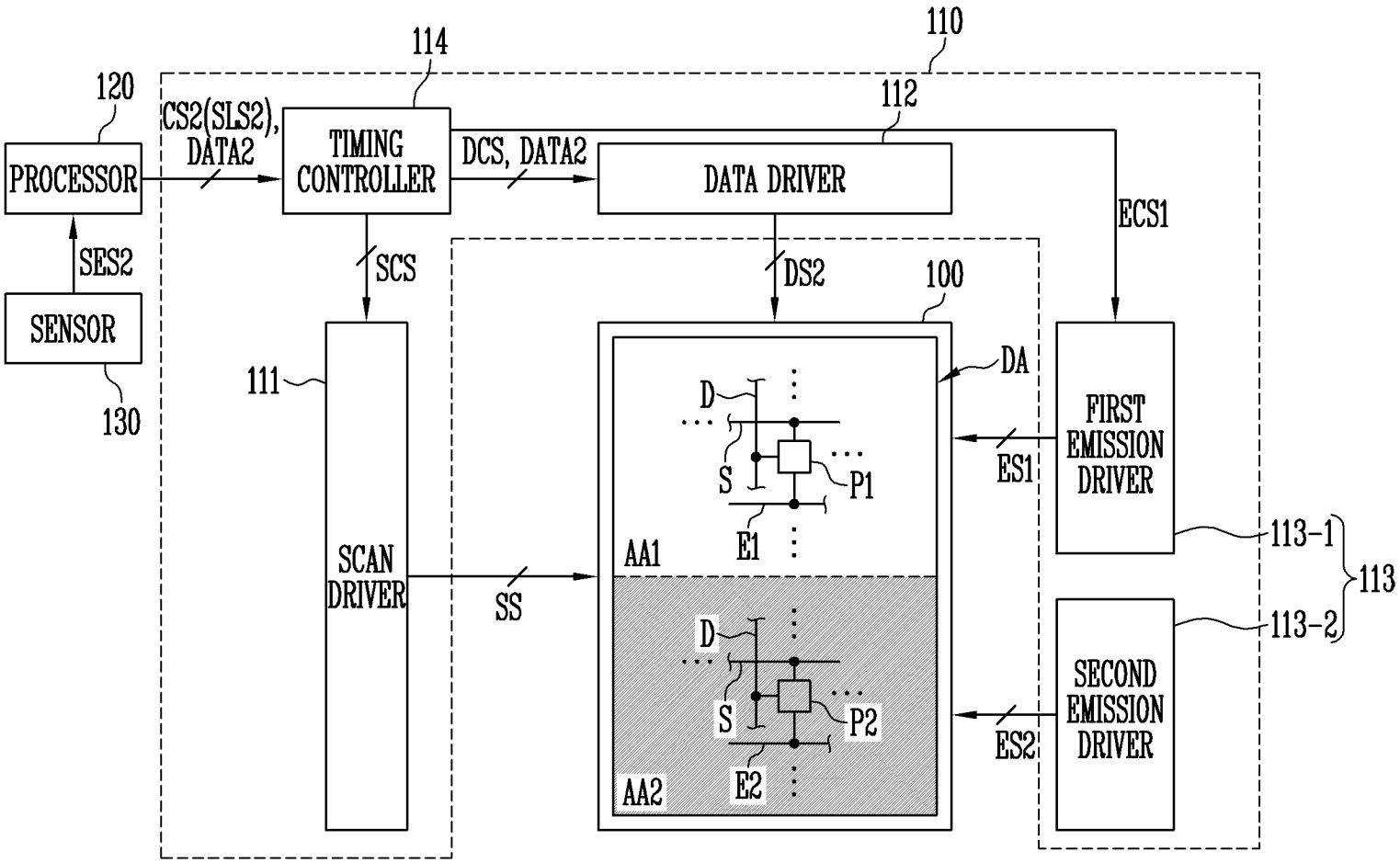
FIG. 9 is a block diagram illustrating an exemplary embodiment of the display device of FIG. 5 when the display device operates in a second mode.
Figure 10:
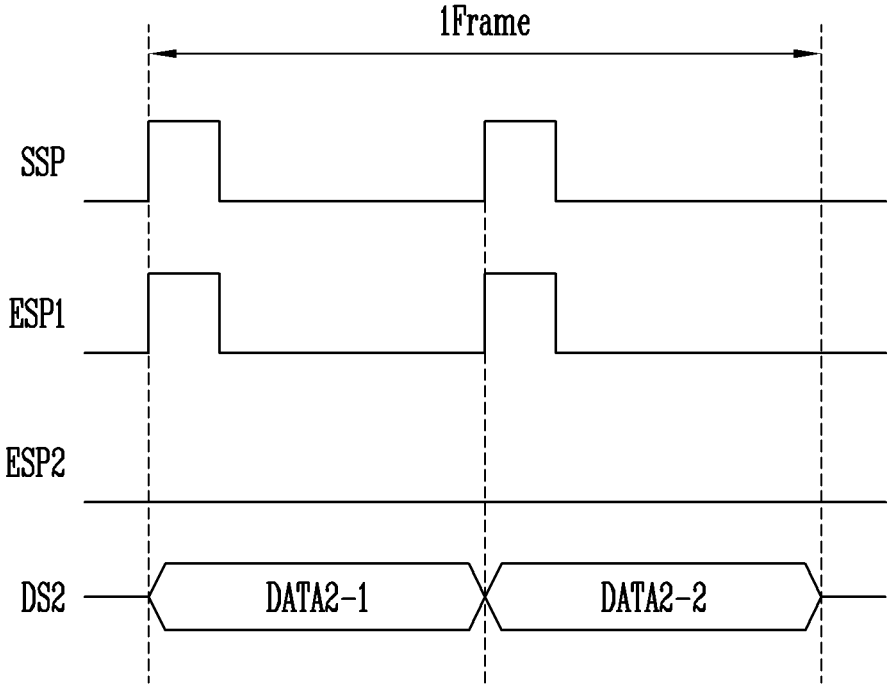
FIG. 10 is a timing diagram of signals applied to the display device of FIG. 5 when the display device operates in the second mode.
Figure 11:
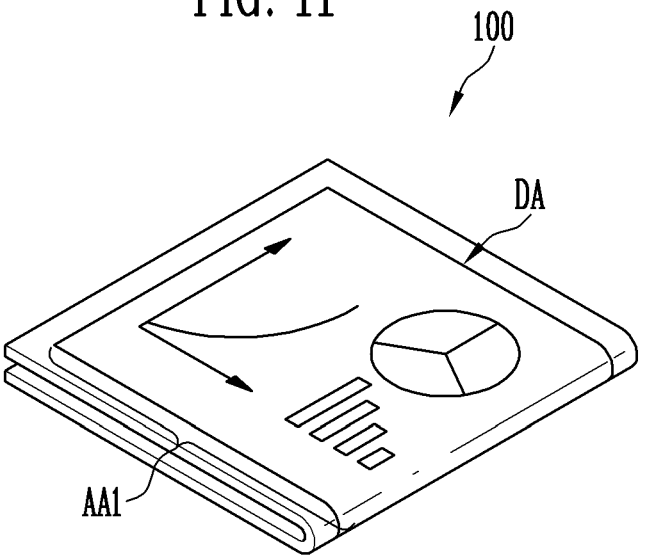
FIGS. 11 and 12 are diagrams illustrating an example of an image displayed in the display area of the display device of FIG. 5 when the display device is driven in the second mode.
Figure 12:
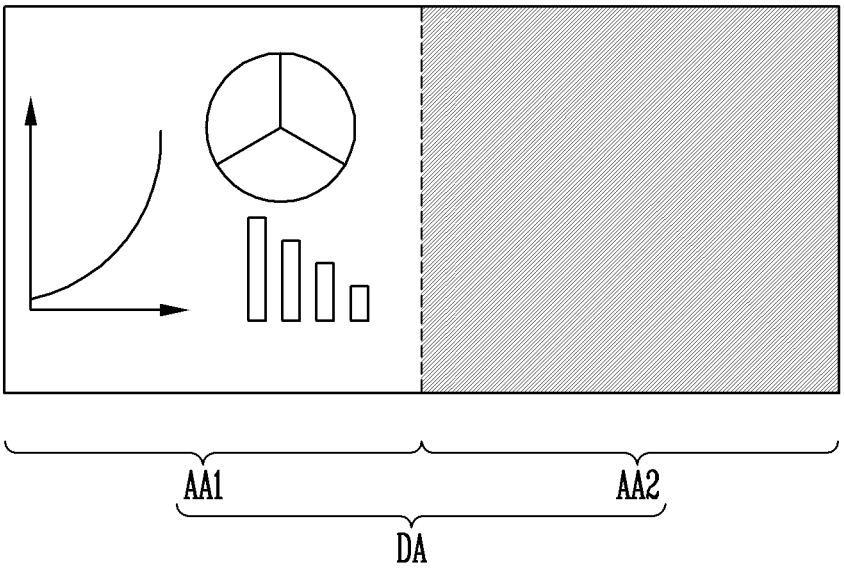

FIG. 9 is a block diagram illustrating an exemplary embodiment of the display device of FIG. 5 when the display device operates in the second mode. FIG. 10 is a timing diagram of signals applied to the display device of FIG. 5 when the display device operates in the second mode. FIGS. 11 and 12 are diagrams illustrating an example of an image displayed in the display area when the display device is driven in the second mode. FIG. 11 illustrates an example of a use condition (or state) of the display device when the display device is driven in the second mode, and FIG. 12 illustrates a state in which a display area shown in FIG. 11 is unfolded so as to represent an on-off state of an inactive display area.

First, referring to FIGS. 9 and 10, the display device may be driven in the second mode depending on a predetermined use environment, a predetermined state, and/or a predetermined condition. In an exemplary embodiment, the second mode may be the partial display mode.

For example, the display device may be driven in the second mode when a second sensing signal SES2 is supplied from the sensor 130. In an exemplary embodiment, the second sensing signal SES2 may be a sensing signal corresponding to a state in which the display panel 100 is folded. For example, the sensor 130 may output the second sensing signal SES2 when the display panel 100 is outwardly folded to a predetermined rotation angle or greater.

When the second sensing signal SES2 is input from the sensor 130, the processor 120 may set a partial area of the display area DA as a active display area, corresponding to the second mode, and set the other area as an inactive display area. Hereinafter, an example in which the first display area AA1 is set as a active display area and the second display area AA2 is set as an inactive display area is assumed.

The processor 120 may generate second image data DATA2 corresponding to the first display area AA1 during a period in which the display device is driven in the second mode. The second image data DATA2 may be data obtained by the size and direction of the first image data DATA1 generated in the first mode, corresponding to the first display area AA1.

Since the processor 120 generates image data, corresponding to the first display area AA1 that is a portion of the entire display area DA, the second image data DATA2 generated in the second mode may have a capacity smaller than that of the first data DATA1. In other words, the processor 120 may generate the second image data DATA2 at a rate faster than that in the first mode. For example, when the processor 120 generates one first image data DATA1 to be displayed in the entire display area DA during one frame period in the first mode, the processor 120 may generate two or more second image data DATA2 to be displayed in the first display area AA1 during one frame period in the second mode. In FIGS. 9 and 10, an exemplary embodiment in which the processor 120 generates second image data DATA2-1 corresponding to a first scene and second image data DATA2-2 corresponding to a second scene at an interval of a half frame in the second mode is illustrated.

Hereinafter, although an example in which the processor 120 generates two second image data DATA2 at an interval of a half frame during one frame period in the second mode is illustrated, the exemplary embodiments are not limited thereto. For example, the processor 120 may generate three or more second image data DATA2 during one frame period depending on the size, position, shape, etc. of the active display area.

The processor 120 may generate a second control signal CS2 corresponding to the second mode, and output the second control signal CS2 to the display driver 110. In some exemplary embodiments, the second control signal CS2 may include a second selection signal SLS2 including information on a selected display mode, i.e., the second mode.

Since the processor 120 generates a plurality of second image data DATA2 during one frame period in the second mode, the processor may generate a second control signal CS2 corresponding to each of the plurality of second image data DATA2, and sequentially output the second control signals CS2 to the display driver 110.

When the second selection signal SLS2 is supplied from the processor 120, the display driver 110 may operate in the second mode. The display driver 110 may generate a second data signal DS2 corresponding to the second image data DATA2, corresponding to the second mode, and supply the second data signal DS2 to the first pixels P1 through the data lines D.

For example, the timing controller 114 may generate a scan control signal SCS and a data control signal DCS in response to the second control signal CS2, and supply the scan control signal SCS and the data control signal DCS respectively to the scan driver 111 and the data driver 112. The scan control signal SCS supplied to the scan driver 111 may include a gate start pulse SSP. Also, the timing controller 114 may supply the second image data DATA2 to the data driver 112.

Also, the timing controller 114 may generate a first emission control signal ECS1, using the second control signal CS2, and supply the first emission control signal ECS1 to the first emission driver 113-1. The first emission control signal ECS includes a first emission start pulse ESP1. Also, in the second mode, the timing controller 114 may not generate any second emission control signal ECS2.

Since a plurality of second image data DATA2 and second control signals CS2 corresponding thereto are supplied from the processor 120 during one frame period in the second mode, the timing controller 114 may sequentially supply the plurality of second image data DATA2 to the data driver 112 during the one frame period. Also, the timing controller 114 may supply a plurality of gate start pulses SSP and a plurality of first emission start signals ESP1 respectively to the scan driver 111 and the first emission driver 113-1, corresponding to the second control signals CS during the one frame period.

In the exemplary embodiment described above, the scan driver 111 may generate a scan signal SS, corresponding to the gate start pulse SSP included in the scan control signal SCS, and sequentially supply the scan signal SS to the scan lines S of the horizontal pixel columns disposed in the display panel 100. In addition, the first emission driver 113-1 may generate an emission signal ES1 in response to the first emission start pulse ESP1, and supply the emission signal ES1 to the first emission control lines E1.

The data driver 112 may generate a second data signal DS2, corresponding to each of the data control signal DCS and first and second second image data DATA2-1 and DATA2-1, and supply the second data signals DS2 to the data lines D. For example, the display driver 110 may supply a second data signal DS2 corresponding to the first second image data DATA2-1 to the data lines D during a half frame period, and supply a second data signal DS2 corresponding to the second second image data DATA2-2 to the data lines during the other half frame period.

The second second image data DATA2-2 is identical to the first second image data DATA2-1 or is based on different active images. For example, when the first second image data DATA2-1 corresponds to a first active image (i.e., a first scene), the second second image data DATA2-2 may correspond to a second active image (i.e., a second scene next to the first scene). Alternatively, in an exemplary embodiment, the second second image data DATA2-2 may be a copy of the first second image data DATA2-1 or be data generated based on an active image interpolated between the first active image and a second active image for an actual next frame in the first mode.

The second data signals DS2 from the data driver 112 may be input to horizontal pixel columns supplied with the scan signal SS during a corresponding horizontal period. For example, the second data signal DS2 may include data signals for a plurality of horizontal lines corresponding to the number of horizontal pixel columns disposed in the first display area AA1, and the data signal for each horizontal line may be supplied to first pixels P1 of a corresponding horizontal pixel column during the corresponding horizontal period.

As described above, the second image data DATA2 is supplied multiple times to the first pixels P1 during one frame period in the second mode. In other words, during the second mode, the display device can operate at a frame rate higher than that in the first mode. Consequently, a high-quality image can be efficiently displayed.

While the display device is operating in the second mode, the second emission control signal ECS2 is not supplied to the second emission driver 113-2, and accordingly, the second emission driver 113-2 does not supply the second emission signal ES2 to the second pixels P2 disposed in the second display area AA2. Thus, although the second data signal DS2 are supplied to the second pixels P2 in response to the scan signal SS, the second pixels P2 do not emit light during the second mode. Accordingly, unnecessary emission of the second display area AA2 or display of a noise image, etc. in the second display area AA2 can be prevented.

In accordance with the exemplary embodiment described above, as shown in FIGS. 11 and 12, an active image corresponding to the second image data DATA2 is displayed in the first display area AA1, and no image is displayed in the second display area AA2.

In the above-described exemplary embodiments, one frame period may include a display period and a non-display period. The non-display period may include, for example, an initialization period for the first and second pixels P1 and P2, a threshold voltage compensation period, a data write period, a sensing period, and the like. Therefore, the one frame period may be replaced with the display period, and the supply timing of each signal may be modified corresponding to the display period.

Figure 13:
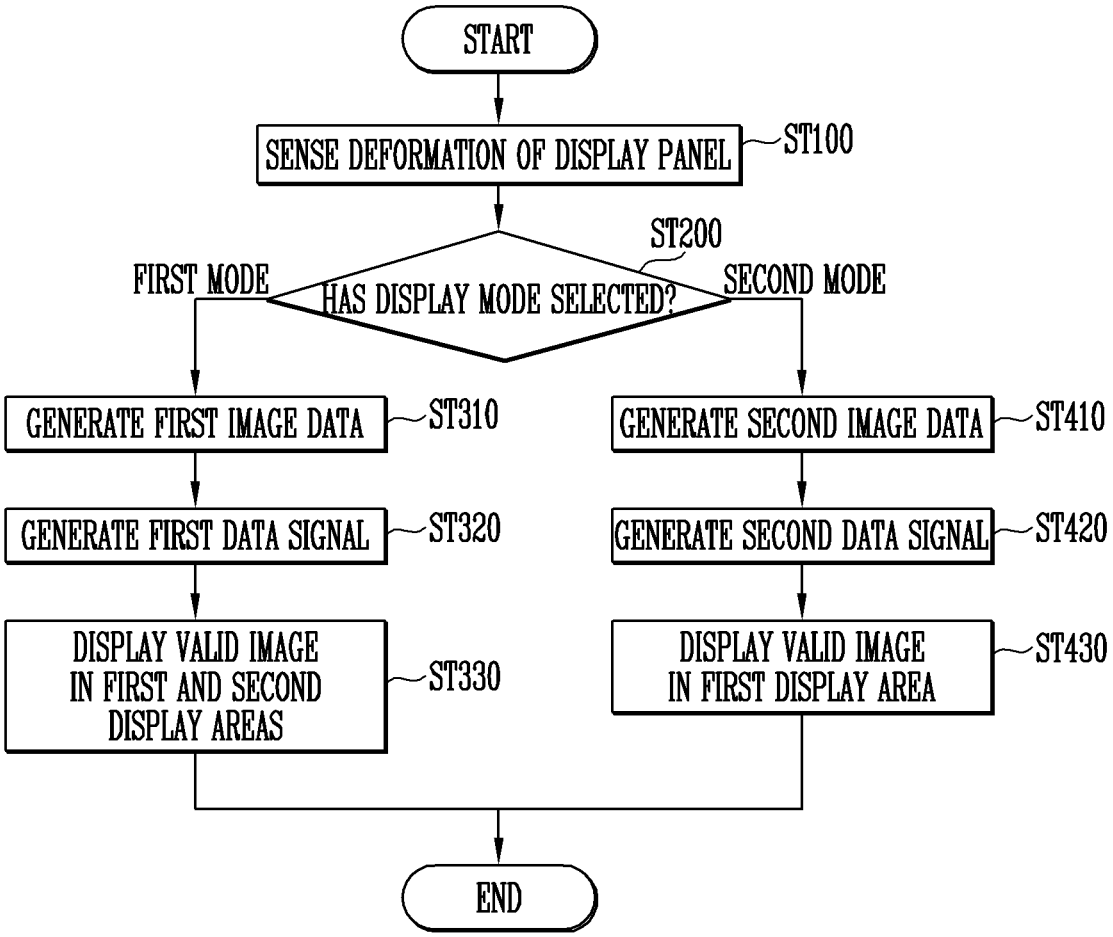
FIG. 13 is a flowchart of a method of driving the display device according to an exemplary embodiment of the invention.

FIG. 13 is a flowchart of a method of driving the display device according to an exemplary embodiment of the invention. Hereinafter, a method of driving the display device in accordance with an exemplary embodiment will be sequentially described in FIG. 13 in conjunction with the above-described exemplary embodiments.

Referring to FIGS. 5 to 13, the display device may sense a deformation of the display panel 100 including the first and second display areas AA1 and AA2 (ST100). For example, the display device may sense a deformation of the display panel 100 by using the sensor 130, and output a sensing signal SES1 or SES2 corresponding to the deformation to the processor 120.

Next, the display device may select a display mode between the first mode and the second mode (ST200). For example, the processor 120 receiving the sensing signal SES1 or SES2 may select one mode between the first mode and the second mode, corresponding to the sensing signal SES1 or SES2. In an exemplary embodiment, when deformation of the display panel 100 is sensed to a predetermined reference value or greater, the processor 120 may select the select mode, and operate corresponding to the second mode. In other cases, the processor 120 may select the first mode, and operate corresponding to the first mode.

When the first mode is selected, the processor 120 of the display device may generate first image data DATA1, and supply the first image data DATA1 to the display driver 110 (ST310). When the first mode is selected, the processor 120 may generate a first control signal CS1, and supply the first control signal CS1 to the display driver 110.

The display driver 110 receiving the first control signal CS1 and the first image data DATA1 from the processor 120 may supply a first data signal DS1 corresponding to the first image data DATA1 to the display panel 100 (ST320).

The display panel 100 receiving the first data signal DS1 may display an active image in the first and second display areas AA1 and AA2, corresponding to the first data signal DS1 (ST330). For example, when the display device is driven in the first mode, the active image may be displayed using the entire display area DA including the first and second display areas AA1 and AA2.

Meanwhile, when the second mode is selected, the processor 120 may generate second image data DATA2 corresponding to only the first display area AA1, and supply the second image data DATA2 to the display driver 110 (ST410). Also, when the second mode is selected, the processor 120 may generate a second control signal CS2, and supply the second control signal CS2 to the display driver 110. A supply interval of the second control signal CS2 is shorter than that of the first control signal CS1.

The display driver 110 receiving the second control signal CS2 and the second image data DATA2 from the processor 120 may generate a second data signal DS2 corresponding to the second image data DATA2, and supply the second data signal DS2 to the display panel 100 (ST420). For example, the data driver 112 provided in the display driver 110 may generate a second data signal DS2 by using the second image data DATA2, and supply the second data signal DS2 to the display panel 100.

The display panel 100 receiving the second data signal DS2 may display an active image in the first display area AA1, corresponding to the second data signal DS2 (ST430). For example, when the display device is driven in the second mode, the active image may be displayed using only the first display area AA1.

Accordingly, when the display device is driven in the second mode, an active image is displayed in the first display area AA1, and the second pixels P2 of the second display area AA2 do not emit light.

Display devices constructed according to the principles of the invention can be selectively driven in the entire display mode or the partial display mode depending on a use environment or state thereof, so that the convenience of use can be improved.

Further, according to the principles and exemplary embodiments of the invention, an image output rate is improved while the display device is being driven in the partial display mode, so that an image that requires a high frame rate, such as a game or sport, can be efficiently displayed in the partial display mode.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device comprising:

a display panel including first and second display areas;

a processor to generate first image data corresponding to the first and second display areas in a first mode, and generate second image data corresponding to the first display area in a second mode; and a display driver to control the display panel to display an image corresponding to the first image data in the first and second display areas according to a first frame period in the first mode, and to display an image corresponding to the second image data in the first display area according to a second frame period in the second mode, the second frame period being shorter than the first frame period, wherein the image corresponding to the second image data comprises a first active image and a second active image, wherein the second active image is a next scene of the first active image or an active image interpolated between the first active image and the next scene of the first active image, and wherein the display driver is configured to display the first active image on the first display area during a half frame period of the second frame period, and to display the second active image on the first display area during the other half frame period of the second frame period.

2. The display device of claim 1, wherein the first image data comprises image data corresponding to pixels constituting the first and second display areas, and the second image data comprises image data corresponding to pixels constituting the first display area, wherein the first image data is generated according to the first frame period, and the second image data is generated according to the second frame period.

3. The display device of claim 1, wherein the display driver comprises:

a timing controller to generate a data control signal and a scan control signal in response to a control signal of the processor;

a data driver to output a first or second data signal corresponding to the first or second image data in response to the data control signal; and a scan driver to output a scan signal in response to the scan control signal.

4. The display device of claim 3, wherein the timing controller is operable to output the scan control signal according to the first frame period in the first mode, and to output the scan control signal according to the second frame period in the second mode.

5. The display device of claim 3, wherein the data driver is operable to output the first data signal according to the first frame period in the first mode, and to output the second data signal according to the second frame period in the second mode.

6. The display device of claim 3, wherein the display driver further comprises:

a first emission driver to supply a first emission signal to the first display area in response to a first emission control signal from the timing controller; and a second emission driver to supply a second emission signal to the second display area in response to a second emission control signal from the timing controller.

7. The display device of claim 6, wherein the timing controller is operable not to output the second emission control signal in the second mode.

8. The display device of claim 1, further comprising a sensor to output a sensing signal by sensing a change in state of the display panel.

9. The display device of claim 8, wherein the processor operates in the first or second mode, corresponding to the sensing signal.

10. The display device of claim 8, wherein the change in state comprises deformation of the display panel.

11. The display device of claim 1, wherein the display panel is operable to be driven in the second mode when the display panel is outwardly folded with respect to a predetermined folding axis.

12. The display device of claim 11, wherein the first display area is an area exposed in a first direction by the outward folding of the display panel, and the second display area is an area exposed in a second direction opposite to the first direction by the outward folding of the display panel.

13. A method of driving a display device, the method comprising:

selecting one of first and second driving modes;

when the first driving mode is selected, displaying a first image corresponding to first image data in first and second display areas according to a first frame period; and when the second driving mode is selected, displaying a second image corresponding to second image data in the first display area according to a second frame period, wherein the second frame period is shorter than the first frame period, wherein the second image corresponding to the second image data comprises a first active image and a second active image, wherein the second active image is a next scene of the first active image or an active image interpolated between the first active image and the next scene of the first active image, and wherein the first active image is displayed on the first display area during a half frame period of the second frame period, and the second active image is displayed on the first display area during the other half frame period of the second frame period.

14. The method of claim 13, wherein displaying of the first image comprises:

generating a scan control signal and a data control signal according to the first frame period; and outputting a scan signal in response to the scan control signal, and outputting a first data signal corresponding to the first image data in response to the data control signal.

15. The method of claim 14, wherein displaying of the first image further comprises:

generating first and second emission control signals; and supplying first and second emission signals to the first and second display areas in response to the first and second emission control signals.

16. The method of claim 13, wherein displaying of the second image comprises:

generating a scan control signal and a data control signal according to the second frame period; and outputting a scan signal in response to the scan control signal, and outputting a second data signal corresponding to the second image data in response to the data control signal.

17. The method of claim 16, wherein displaying of the second image further comprises:

generating a first emission control signal; and supplying a first emission signal to the first display area in response to the first emission control signal.

18. The method of claim 13, wherein selecting of the one of the first and second driving modes comprises:

sensing a change in state of a display panel; and selecting the first driving mode or the second driving mode, based on the sensing result.

19. The method of claim 18, wherein selecting of the first driving mode or the second driving mode comprises selecting the second driving mode, when a display panel is outwardly folded with respect to a predetermined folding axis.

20. The method of claim 19, wherein the first display area is an area exposed in a first direction by the outward folding of the display panel, and the second display area is an area exposed in a second direction opposite to the first direction by the outward folding of the display panel.

* * * * *